US006705609B2

(12) United States Patent
Kim

(10) Patent No.: US 6,705,609 B2
(45) Date of Patent: Mar. 16, 2004

(54) APPARATUS FOR SENSING THE FEEDING OF SHEETS OF PAPER

(75) Inventor: Dong-gyun Kim, Seoul (KR)

(73) Assignee: FL Technology Inc, Seoul (KR)

( * ) Notice: Subject to any disclaimer, the term of this patent is extended or adjusted under 35 U.S.C. 154(b) by 8 days.

(21) Appl. No.: 10/115,612

(22) Filed: Apr. 2, 2002

(65) Prior Publication Data

US 2002/0139728 A1 Oct. 3, 2002

(30) Foreign Application Priority Data

Apr. 2, 2001 (KR) ..... 2001-17372

(51) Int. Cl.[7] ..... B65H 7/12

(52) U.S. Cl. ..... 271/262; 271/263; 271/265.04

(58) Field of Search ..... 271/263, 262, 271/265.04; 324/207.11, 207.25, 229; 73/159

(56) References Cited

U.S. PATENT DOCUMENTS 5,011,127 A * 4/1991 Hamilton et al. ..... 271/262
5,437,445 A * 8/1995 Chang et al. ..... 271/263
6,000,693 A * 12/1999 Tranquilla ..... 271/263
6,308,951 B1 * 10/2001 Allmendinger et al. 271/265.04
2001/0022422 A1 * 9/2001 Tamura ..... 271/10.03
2001/0042957 A1 * 11/2001 Luther ..... 271/273

* cited by examiner

*Primary Examiner*—Donald P. Walsh
*Assistant Examiner*—Kaitlin Joerger

(57) ABSTRACT

Disclosed is an apparatus for sensing the feeding of individual sheets of paper in which the feeding of two or more overlapping sheets can be detected in a sheet feeding apparatus for continuously transferring sheets of paper one by one along a predetermined paper traveling path. The apparatus employs a support plate which allows the sheets of paper to slide, and a contact arm adapted to contact the support plate and to be moved upward by a height corresponding to the thickness of the sheet of paper when the sheet of paper passes between the support plate and the contact arm, instead of using an expensive rollers, bearings or the like as a means for sensing the thickness of a sheet of paper being fed. Accordingly, the rotational angle of the contact arm enables the thickness of a sheet of paper being fed to be sensed, so that the feeding of two or more overlapping sheets of paper between a driving roller and a driven roller is always detected correctly and reliably even when foreign matter is stuck to the rollers. Further, the paper feed sensing apparatus has a simple structure and malfunctions less.

20 Claims, 6 Drawing Sheets

APPARATUS FOR SENSING THE FEEDING OF SHEETS OF PAPER

BACKGROUND OF THE INVENTION

1. Field of the Invention

The present invention relates to an apparatus for sensing the feeding of individual sheets of paper, and more particularly, to an apparatus for sensing the feeding of individual sheets of paper in which the feeding of two or more overlapping sheets can be detected in a sheet feeding apparatus for continuously transferring sheets of paper one by one along a predetermined paper traveling path 2. Description of the Related Art In general, such a sheet feeding apparatus can be adapted for use in combination with, for example, a printing machine in a printing house, an automatic teller machine (ATM) in a bank, and the like. The sheet feeding apparatus is equipped with a driving roller and a driven roller which contact each other, and has a sheet feeding scheme in which a sheet of paper is fed between the driving roller and the driven roller such that they are compressed against the sheet of paper For example, in the case of a printing machine in a printing house, individual sheets of paper to be printed are transferred from section to section so that different processes are performed in sequences and if the individual sheets of paper are not correctly supplied, there may be a paper jam or printing may be adversely affected. In addition, in the case of an automatic teller machine (ATM), the number of bills of cash and bank notes dispensed by the ATM must be accurately checked.

When a sheet feeding apparatus for transferring individual sheets of paper does not supply sheets of paper one by one but rather feeds two or more sheets of paper at a time, an error occurs in the sheet feeding apparatus during its feeding operation and this can lead to further problems as well. Thus, it is required to always check the thickness of a sheet of paper fed between two corresponding rollers pressed against the sheet of paper.

FIG. 1 is a schematic longitudinal sectional view illustrating the construction of a typical sheet feeding apparatus given as an example to explain a conventional individual paper feed sensing apparatus.

Referring to FIG. 1, the sheet feeding apparatus is provided with a plurality of pairs of driving roller 12 and a driven roller 14 which are supported on a frame 10 The outer surfaces of the driving roller 12 and the driven roller 14 in each pair are in contact with each other to discharge to the outside a sheet of paper P fed therebetween along a predetermined paper traveling path. The driving rollers 12 are mechanically coupled to each other through a power transfer means such as gears, belts or the like, and rotate by means of a separate drive motor (not shown) to feed a sheet of paper along the predetermined paper traveling path such that the driving rollers 12 and the driven rollers 14 are compressed against the sheet of paper.

In the meantime, the sheet feeding apparatus as constructed above includes a paper feed sensing apparatus for detecting the thickness of a sheet of paper being fed. The paper feed sensing apparatus functions to check a space between the driving rollers 12 and the driven rollers 14 which are in contact with each other. There are also diverse kinds of paper feed sensing apparatuses, but almost all paper feed sensing apparatuses employ a paper feed sensing mechanism in which they detect a physical variation in the space between the driving rollers 12 and the driven rollers 14 and then output the detected result to the outside through an electronic sensor 18.

For this purpose, a driving roller 12 and a driven roller 14 coupled to the sensor 18 are replaced by a metal driving roller 20 and a support bearing 22, respectively, which have been machined very precisely. The outer surface of the metal driving roller 20 is treated very precisely and its concentricity is very precise. The support bearing 22 serves as a driven roller whose outer surface is in contact with that of metal driving roller 20. Of course, the support bearing 22 is manufactured such that its outer surface is also treated very precisely to have more precise concentricity.

The metal driving roller 20 and the support bearing 22, machined precisely as mentioned above, are coupled to the sensor 18. Accordingly, when there is a variation in the thickness of a sheet of paper passing between the metal driving roller 20 and the support bearing 22, the distance between the center axes of rotational motion of the metal driving roller 20 and the support bearing 22 are also changed, which is detected by the sensor 18.

However, in the case of such a conventional paper feed sensing apparatus, when the metal driving roller 20 and the support bearing 22 are not manufactured with sufficient precision, the apparatus does not operate reliably. Generally, a sheet of paper has a thickness of 0.1 mm or less. Thus, if either the metal driving roller 20 or the support bearing 22 is slightly eccentric or its outer surface is slightly non-uniform, the thickness of a sheet of paper being fed cannot be detected correctly.

For example, when a sheet of paper having a thickness of 0.1 mm passes between the metal driving roller 20 and the support bearing 22 in a state in which external foreign matter is adhered to the outer surface of either the metal driving roller 20 or the support bearing 22, the sensor 18 detects the total thickness obtained by adding the thickness of the sheet and that of the foreign matter. At this time, if the thickness of the foreign matter is 0.1 mm, the sensor 18 will recognize one sheet of paper as two sheets of paper.

Moreover, the sensor 18 measures the distance between the rotational center axes of the metal driving roller 20 and the support bearing 22 to detect a variation in the distance. Accordingly, if foreign matter adhered to the outer surface of either the metal driving roller 20 or the support bearing 22 has an irregular thickness or pattern, there occurs a variation in the distance between the rotational center axes of the metal driving roller 20 and the support bearing 22, which may make it impossible to measure the distance between the rotational center axes thereof. Further, when the support bearing is constructed as a ball having a number of balls fit into a space between the rotational center axis and the outer surface of a wheel portion, the space between the rotational center axis and the outer surface of the wheel portion is not constant on a microscopic level.

As a result, for the above-mentioned conventional paper feed sensing apparatus, there is the problem in that it must employ a high-priced metal driving roller 20 and support bearing 22 whose outer surface is machined very precisely and whose concentricity is very precise, thereby increasing the manufacturing cost. In addition, there is a limitation of measurement in that when foreign matter is adhered to the outer surface of either the metal driving roller 20 or the support bearing 22, measurement is inaccurate. There arises a further problem in that a separate device for preventing the adhesion of foreign matter is required, thereby increasing both the complexity of the paper feed sensing apparatus and the frequency of malfunction.

SUMMARY OF THE INVENTION

To solve the above-described problems, it is a primary object of the present invention to provide an apparatus for sensing the feeding of individual sheets of paper adapted for use with a sheet feeding apparatus, which can simplify the structure of the sheet feeding apparatus, reduce the frequency of malfunction, and enable the feeding of two or more overlapping sheets of paper between driving rollers and driven rollers to always be detected correctly and reliably irrespective of presence of foreign matter on the rollers and without using expensive rollers, bearings or the like as a means for sensing the thickness of a sheet of paper being fed.

To accomplish the primary object of the present invention, there is provided an apparatus for sensing the feeding of individual sheets of paper which is adapted for use with a sheet feeding apparatus including a plurality of pairs of a driving roller and a driven roller which continuously feed a plurality sheets of paper one by one along a predetermined paper traveling path, the apparatus for sensing the feeding of individual sheets of paper comprising a support plate mounted between and adapted to support a sheet of paper passing between the driving roller and driven roller of each of the plurality of pairs of a driving roller and a driven roller along the predetermined paper traveling path, the support plate having a plurality of driving roller through-holes formed thereon which allows the plurality of pairs of a driving roller and a driven roller to contact each other therethough, a rotating shaft rotatably mounted over the top surface of the support plate, parallel to the support plate, an extending contact arm fixedly mounted on the rotating shaft with one end portion thereof extending toward the support plate to contact the top surface of the support plate, the extending contact arm being moved upward from the top surface of the support plate by a height corresponding to the thickness of the sheet of paper when the sheet of paper passes along the support plate thus causing the rotating shaft to rotate, an amplifying section operatively coupled to the rotating shaft to amplify an amount of rotation of the rotating shaft, and a sensor operatively coupled to the amplifying section for sensing the amount of rotation amplified by the amplifying section, wherein the feeding of two or more overlapping sheets of paper between the pairs of a driving roller and a driven roller is detected.

Also, the apparatus may further comprise a cover plate disposed between the support plate and the rotating shaft in parallel with and spaced apart from the support plate, thus defining the predetermined paper traveling path between the support plate and the cover plate and guiding the sheet of paper passing on the support plate along the predetermined paper traveling path, the cover plate having a plurality of driven roller through-holes which allow parts of lower portions of the driven rollers to pass therethrough so that the outer surfaces of both the driving rollers and the driven rollers contact each other, and a plurality of extending contact arm through-holes which are each disposed between two driven roller through-holes and allow bottom portions of the extending contact arms to pass therethrough so that the bottom portions of the extending projections contact the top surface of the support plate.

The amplifying section preferably includes a pivoting rod fixedly mounted at one end thereof on one end of the rotating shaft and extending perpendicular to the rotating shaft, a connecting shaft fixedly connected to the other end of the pivoting rod and disposed parallel to the rotating shaft, and a link member rotatably connected at one end to the connecting shaft and disposed parallel to the pivoting rod.

Also, the sensor is preferably a magnetic sensor with a rotational center axis is rotatably connected to the other end of the link member.

The length of the end portion of the extending contact arm extending toward the support plate is preferably smaller than that of the pivoting rod.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Hereinafter, the present invention will be described in detail with reference to the accompanying drawings.

Figure 1:
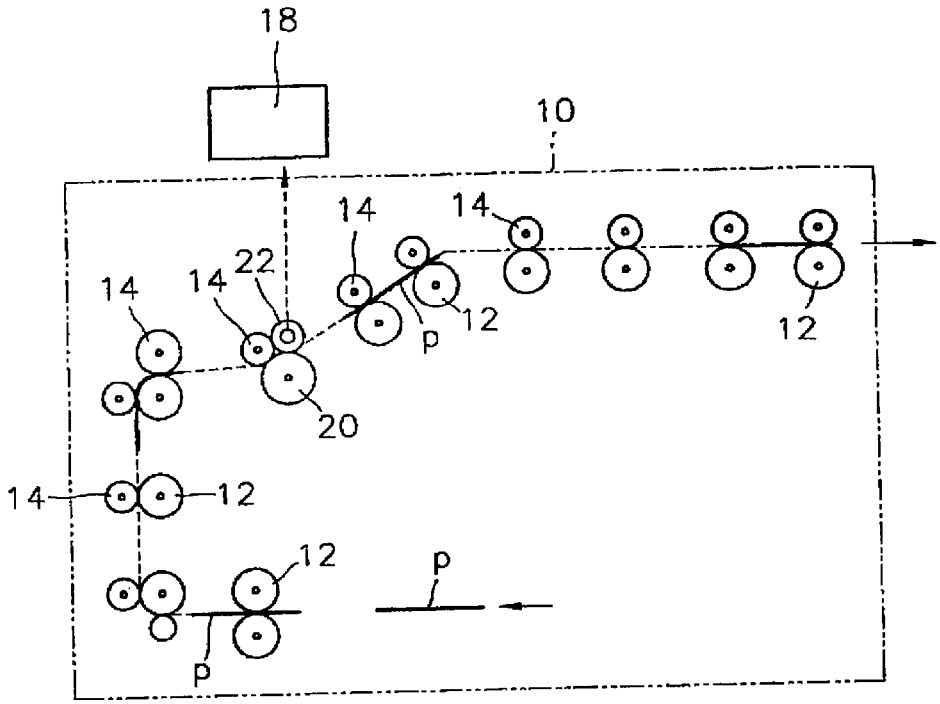
FIG. 1 (PRIOR ART)
FIG. 1 is a schematic longitudinal sectional view illustrating the construction of a typical sheet feeding apparatus.
Figure 2:
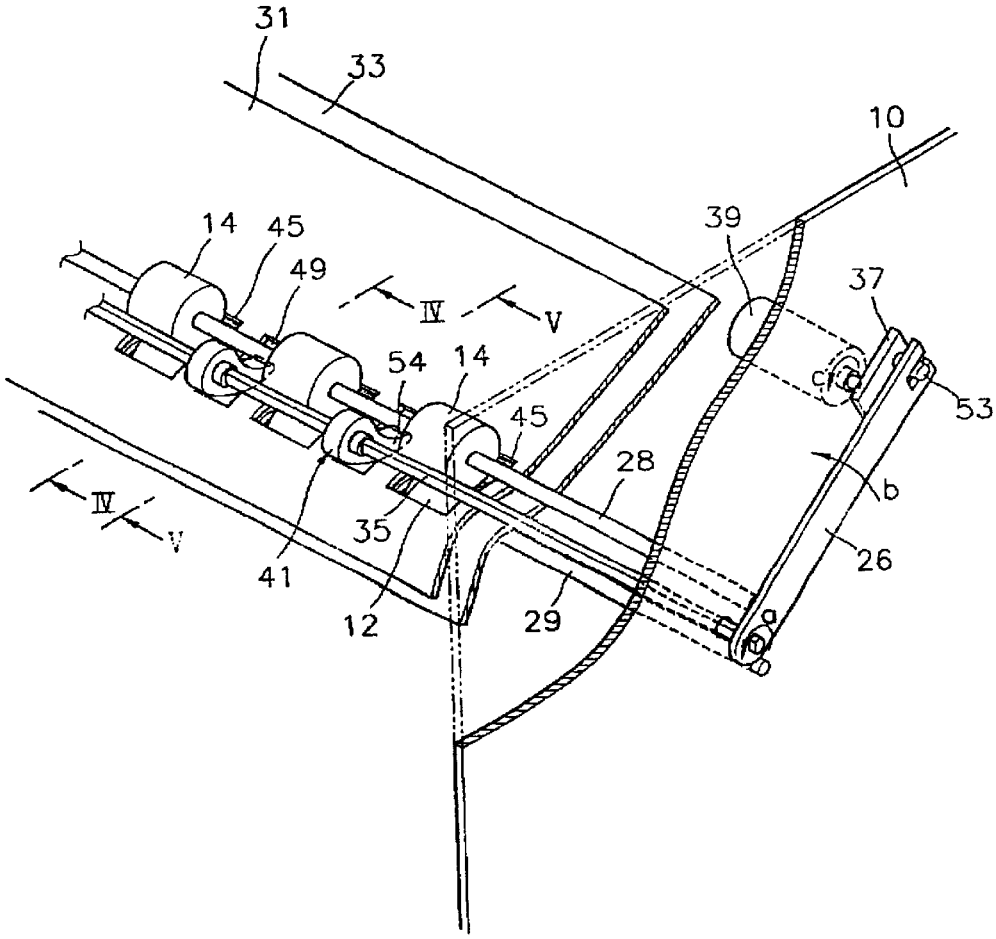
FIG. 2 is a partially cut-away perspective view illustrating the construction of a paper feed sensing apparatus according to an embodiment of the present invention which is in an assembled state.

FIG. 2 is a partially cut-away perspective view illustrating the construction of a paper feed sensing apparatus according to an embodiment of the present invention which is in an assembled state.

Referring to FIG. 2, a plurality of driving rollers 12 and driven rollers 14 are fixedly mounted on a driving shaft 29 and a driven shaft 28, respectively, each of which is rotatably mounted at one end to a frame 10. The driving rollers 12 and the driven rollers 14 function to transfer a sheet of paper. FIG. 2 shows only rollers where the sheet feed sensing apparatus of the present invention is installed.

As shown in FIG. 2, a sheet feed sensing apparatus according to the present invention includes a cover plate 31 and a support plate 33, a rotating shaft 35, an extending contact arm 41, a pivoting rod 26, and a link member 37.

The cover plate 31 and support plate 33 are fixedly mounted to the frame 10 to allow a sheet of paper to be fed through a passage formed therebetween. The rotating shaft 35 is disposed in parallel with the driven shaft 28 over the top surface of the cover plate 31 and is rotatably mounted at one end to the frame 10. The extending contact arm 41 is fixedly mounted on the rotating shaft 35 and one end portion thereof passes through the cover plate 31 to contact the top surface of the support plate 33. The pivoting rod 26 is fixedly mounted at one end portion on the one end of the rotating shaft 35. And, the link member 37 is relatively rotatably coupled at one end to the other free end portion of the pivoting rod 26 for connecting a magnetic sensor 39 to the free end portion of the pivoting rod 26.

Further, the driving rollers 12 and the driven rollers 14 contact each other through the cover plate 31 and the support plate 33.

The support plate 33 has a curved surface and a uniform thickness to correspond to a paper traveling path. Also, the support plate 33 is located between the driving rollers 12 and the driven rollers 14 and has a number of driving roller through-holes 47 (see FIG. 3) formed thereon so that the driving rollers 12 and the driven rollers 14 can contact each other through the roller through-holes 47. Of course, the shape of the support plate 33 may be diversely modified according to various embodiments.

Figure 3:
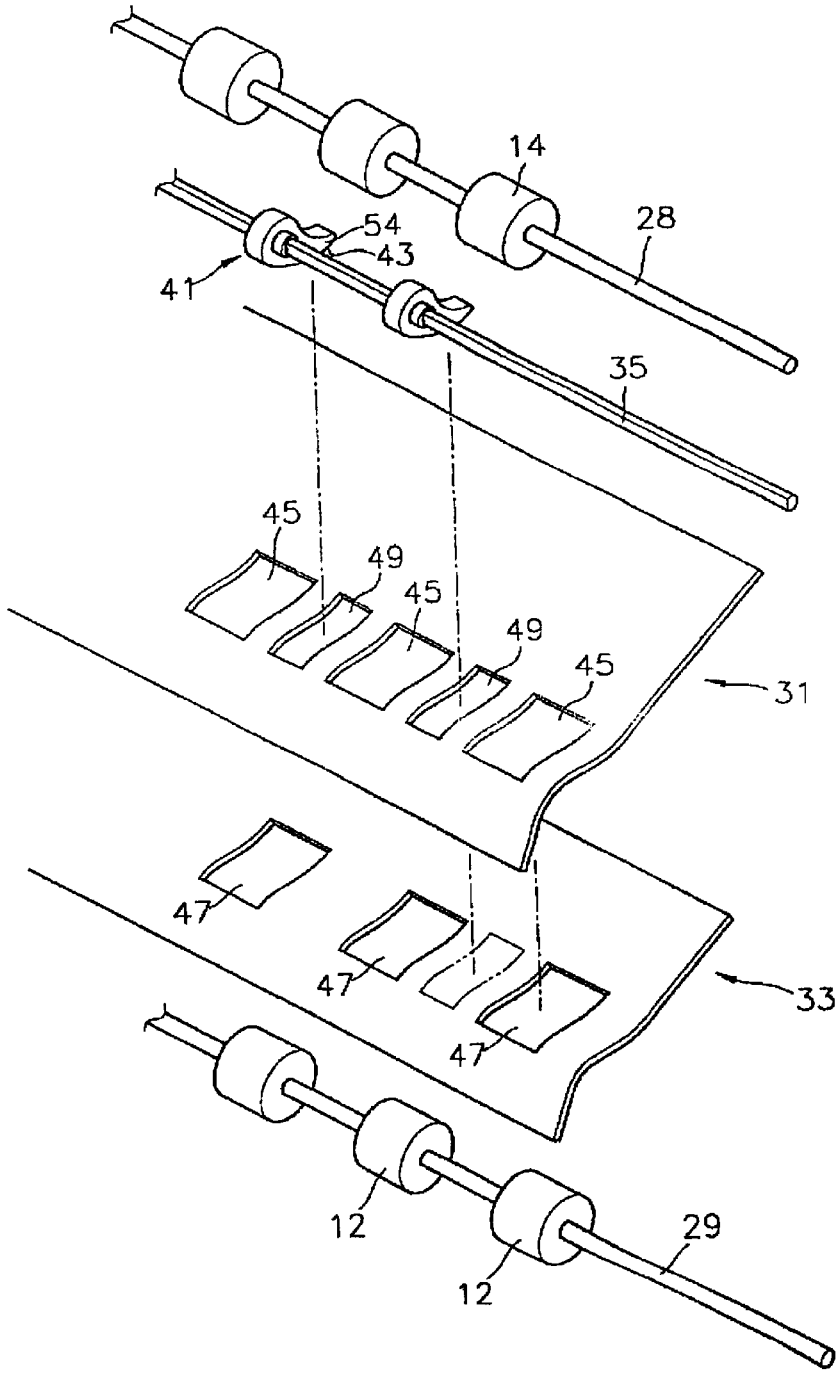
FIG. 3 is an exploded perspective view illustrating the construction of the paper feed sensing apparatus of FIG. 2.
Figure 4:
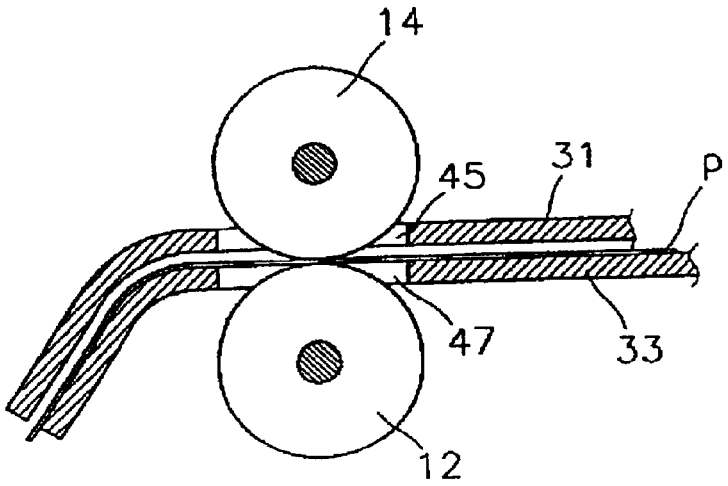
FIG. 4 is a cross-sectional view taken along line IV—IV in FIG. 2, which shows a sheet feeding construction in which a sheet of paper is transferred between a driving roller 12 and a driven roller 14.

The driving roller through-holes 47 (see FIG. 3) are provided such that they receive the upper portions of the driving rollers 12 to allow the outer surfaces of both the driving rollers 12 and the driven rollers 14 to contact each other, and, as shown in FIG. 4, the driving rollers 12 are inserted into the driving roller through-holes 47 by the thickness of the support plate 33. Therefore, the upper portions of the driving rollers 12 inserted into the driving roller through-holes 47 lie substantially flush with the top surface of the support plate 33, and a sheet of paper passing between the driving rollers 12 and the driven rollers 14 beyond the driving roller through-holes 47 is not bent upward nor downward.

The cover plate 31 is spaced apart from and parallel to the support plate 33 to define a predetermined paper traveling path therebetween, and is fixedly mounted to the frame 10. As shown in FIG. 3, the cover plate 31 guides a sheet of paper passing on the support plate 33 along the predetermined paper traveling path and has a number of driven roller through-holes 45 and extending contact arm through-holes 49 formed thereon.

The driven roller through-holes 45 (see FIG. 3) are provided such that they receive the lower portions of the driven rollers 14 to allow the outer surfaces of both the driving rollers 12 and the driven rollers 14 to contact each other. Also, the extending contact arm through-holes 49 are provided such that they receive the extending projections 54 of the extending contact arms 41 to allow a contact surface 43 (see FIGS. 3 and 5) of the extending projections 54 to contact the top surface of the support plate 33.

The rotating shaft 35, which is disposed in parallel with the driven shaft 28 over the top surface of the cover plate 31, is rotatably mounted at one end to the frame 10, and fixedly mounts the plurality of extending contact arms 41 thereon.

Figure 5:
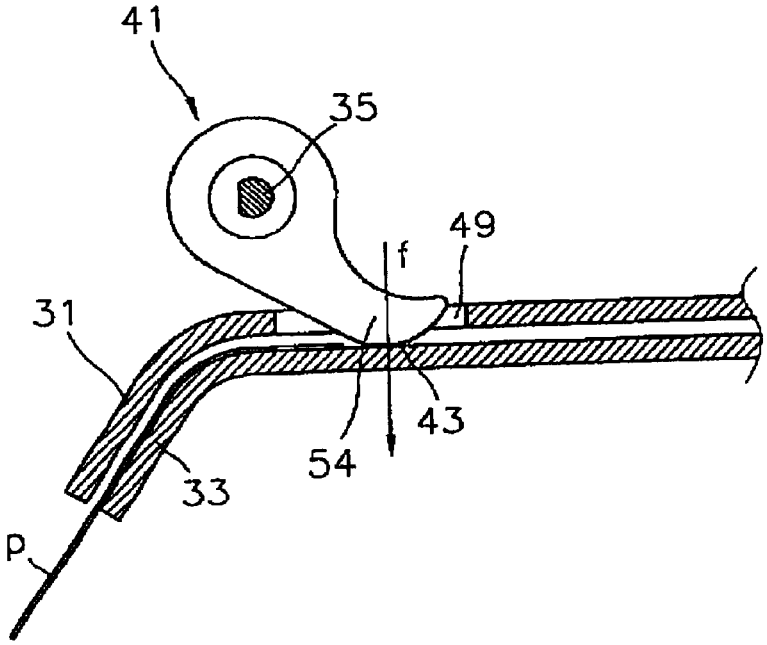
FIG. 5 is a cross-sectional view taken along line V—V in FIG. 2.

The extending contact arms 41 are fixedly mounted on the rotating shaft 35 to each correspond to one of the extending contact arm through-holes 49. Each of the extending contact arms 41 includes the extending projection 54 which extends toward the top surface of the support plate 33 from one side of the outer surface of the extending contact arm like a cam. The extending projection 54 passes though an extending contact arm through-hole 49 to allow a contact surface thereof to contact the top surface of the support plate 33. Also, as shown in FIG. 5, the bottom surface of the extending projection 54 of the extending contact arm 41 is curved so that the contact surface 43 thereof, which contacts the top surface of the support plate 33 is rounded.

Accordingly, the support plate 33 and the cover plate 31 are fixedly mounted to the frame 10 such that they define a predetermined paper traveling path therebetween. The driving rollers 12 and the driven rollers 14 contact each other through the driving roller through-holes 47 and the driven roller through-holes 45. In addition, the extending projections 54 of the extending contact arms 41 pass through the extending contact arm through-holes 49 to allow the contact surfaces 43 thereof to contact the top surface of the support plate 33. After that, the extending projections 54 wait for a sheet of paper to come along the predetermined paper traveling path defined between the support plate 33 and the cover plate 31.

In the meantime, the pivoting rod 26 is fixedly mounted at one end portion to one end of the rotating shaft 35, perpendicular to the rotating shaft 35, to thus rotate together with the rotating shaft 35. Also, the other end portion of the pivoting rod 26 is coupled to the magnetic sensor 39 through the link member 37.

The magnetic sensor 39 is a well-known sensor which generates electrical current when a center shaft 51 (see FIG. 6) thereof rotates to detect the passing of a sheet of paper between the driving rollers 12 and the driven rollers 14 and transmits the detected result to an external controller (not shown). A body of the magnetic sensor 39 is fixedly mounted to the frame 10, and the sensor shaft 51 thereof is fixedly connected to an end of the link member 37.

The link member 37 acts to convert the pivotal movement of the pivoting rod 26 into the rotational movement of the sensor shaft 51 of the magnetic sensor 39, which is coupled at one end to a free end portion of the pivoting rod 26 through a connecting shaft 53 thereof and is rotatably coupled at the other end to the center axis of the magnetic sensor 39. At this time, the connecting shaft 53 of the link member 37 is rotatably coupled to the link member 37 and is fixedly mounted to the free end portion of the pivoting rod 26. Here, the pivoting rod 26, the connecting shaft 53 and the link member 37 constitute an amplifier for amplifying an amount of rotation of the rotating shaft 35 to axially rotate the sensor shaft 51 of the magnetic sensor 39.

Therefore, when the rotating shaft 35 rotates by a certain angle in the direction of an arrow "a", the pivoting rod 26 pivots in the direction of an arrow "b" around the rotating shaft 35, which causes the sensor shaft 51 of the magnetic sensor 39 to rotate in the direction of an arrow "c". The pivotal movement of the pivoting rod 26 in the direction of the arrow "b" occurs when a sheet of paper passes between the top surface of the support plate 33 and the contact surfaces 43 of the extending projection 54 which are in contact with each other.

Consequently, the paper feed sensing apparatus of the present invention detects an ascending degree of the contact surfaces 43 (see FIG. 5) which are moved upward by a height corresponding to the thickness of the sheet of paper being fed by means of the magnetic sensor 39 when a sheet of paper passes between the support plate 33 and the extending contact arms 41. Of course, the greater the ascending degree of the contact surfaces 43, the larger an angle of rotation of the sensor shaft 51 of the magnetic sensor 39.

FIG. 3 is an exploded perspective view illustrating the construction of the paper feed sensing apparatus of FIG. 2.

As shown in FIG. 3, the support plate 33 with a certain thickness has a plurality of driving roller through-holes 47 formed uniformly spaced apart thereon. Each of the driving roller through-holes 47 is of a quadrangular shape and a part of an upper portion of a corresponding driving roller 12 is moved upward and inserted into each driving roller through-hole 47 by the thickness of the support plate 33.

The cover plate 31 positioned over the support plate 33 also has a plurality of driven roller through-holes 45 of a quadrangular shape formed thereon to correspond to one of the plurality of driving roller through-holes 47. Each of the driven roller through-holes 45 functions as a passage for making it possible for a part of the lower portion of the driven rollers 14 to downwardly pass therethrough so that the outer surfaces of both the driving rollers 12 and the driven rollers 14 contact each other.

Also, each of the extending contact arm through-holes 49 of a rectangular shape, which is disposed between a pair of driven roller through-holes 45, functions as a passage for making it possible for the extending projections 54 of the extending contact arms 41 to pass therethrough so that the contact surface 43 of the extending projections 54 comes into contact with the top surface of the support plate 33. According to other embodiments, the extending contact arm through-hole 49 and the driven roller through-hole 45 may be formed as an integrated single hole.

The extending projection 54 of the extending contact arm 41 fixedly mounted on the rotating shaft 35 is bent upward so that the bottom surface thereof, i.e., the contact surface 43, is curved. The contact surface 43 comes into contact with a sheet of paper being fed along the predetermined paper traveling path defined between the support plate 33 and the cover plate 31 so that it is upward pushed to be spaced apart from the support plate 33. In this way, since the contact surface 43 is curved, a sheet of paper can easily enter a contact boundary portion between the extending contact arm 41 and the support plate 33.

Figure 6:
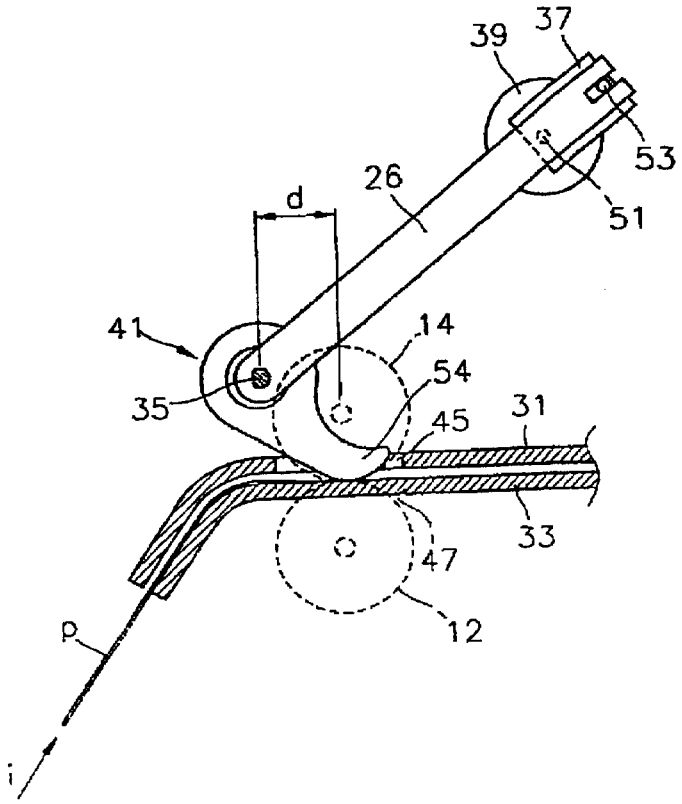
FIGS. 6, 7 and 8 are views illustrating the operation of a paper feed sensing apparatus according to an embodiment of the present invention

In the meantime, the rotating shaft 35 fixedly supporting the extending contact arm 41 and the contact surface 43 are spaced apart from each other by a distance of "d" as shown in FIG. 6. The aim of this is to enable the rotating shaft 35 to rotate in response to the upwardly rotational movement of the extending projection 54 as well as to make it possible for the contact surface 43 to press against the top surface of the support plate 33 by means of a load of the extending projection 54.

FIG. 4 is a cross-sectional view taken along line IV—IV in FIG. 2, which shows a sheet feeding construction in which a sheet of paper is transferred between a driving roller 12 and a driven roller 14.

Referring to FIG. 4, it can be seen that a driving roller 12 and a driven roller 14 are guided into the driving roller through-hole 47 and the driven roller through-hole 45, respectively, to contact each other. At this time, the upper portion of the driving roller 12 lies substantially flush with the top surface of the support plate 33. Accordingly, in the case where a sheet of paper (p) is fed along the predetermined paper traveling path defined between the support plate 33 and the cover plate 31, although the sheet of paper passes the upper portion of driving roller through-hole 47, it can be continuously transferred without being depressed downwardly.

FIG. 5 is a cross-sectional view taken along line V—V in FIG. 2.

Referring to FIG. 5, the extending projection 54 of the extending contact arm 41 fixedly mounted on the rotating shaft 35 is guided into the extending contact arm through-hole 49 so that its contact surface 43 comes into contact with the top surface of the support plate 33. The contact surface 43 of the bottom portion of the extending projection 54 is always biased downward in the direction of an arrow "f" relative to the top surface of the support plate 33 by the load of the extending projection. That is, in the extending contact arm 41, the extending projection side is heavier by virtue of its asymmetrical structure due to the extending projection 54, so that the contact surface 43 presses down against the top surface of the support plate 33 with a force corresponding to the weight of the extending projection 54.

However, since the force applied downward in the direction of an arrow "f" through the contact surface 43 is smaller than the feeding force of a sheet of paper (p), it does not interfere with the movement of the sheet of paper. Accordingly, when the sheet of paper (p) is slid between the contact surface 43 of the extending contact arm 41 and the top surface of the support plate 33, the extending projection 54 is pushed upward by the thickness of the guided sheet of paper (p) so that the contact surface 43 ascends by a height corresponding to the thickness of the sheet of paper (p) while being pressed against the top surface of the sheet of paper (p) downward in the direction of an arrow "f".

The operation of a paper feed sensing apparatus according to an embodiment of the present invention will be described in detail hereinafter with reference to FIGS. 6, 7 and 8.

Figure 7:
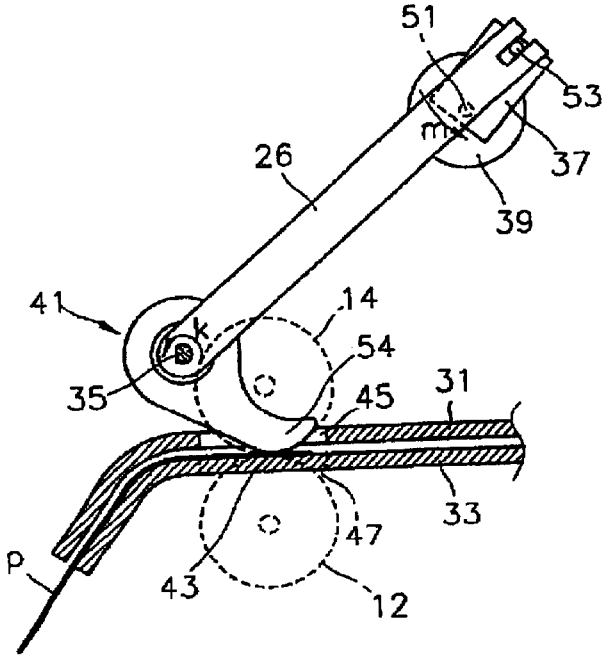
Figure 8:
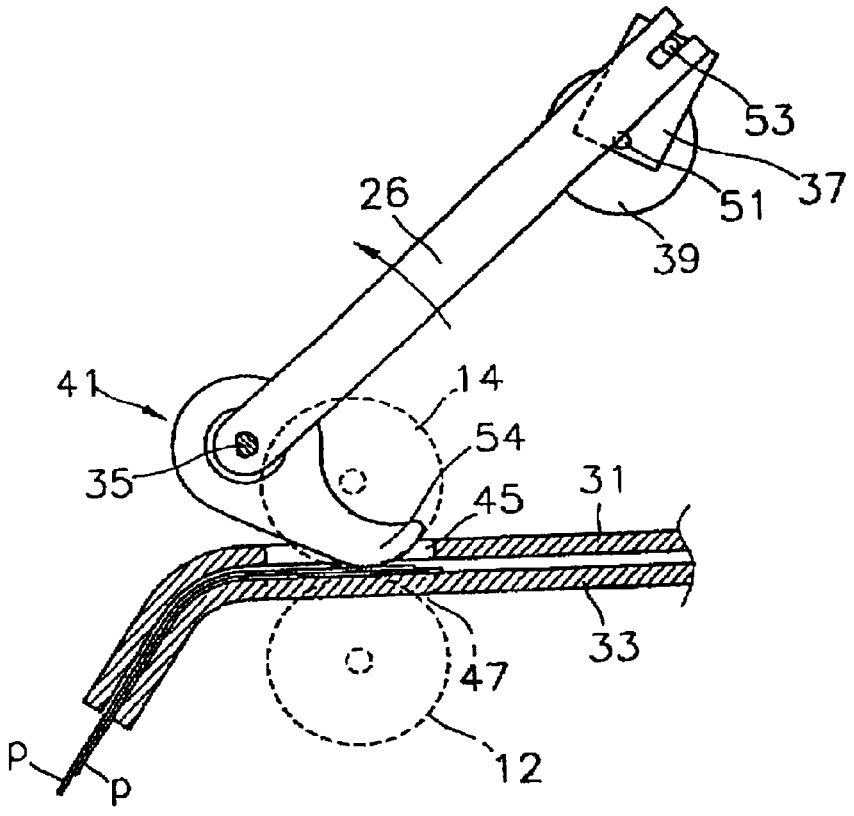

FIGS. 6, 7 and 8 are cross-sectional views illustrating the operation of the sheet feeding apparatus according to the present invention.

FIG. 6 shows the operation just before a sheet of paper (p) is inserted between the support plate 33 and the cover plate 31.

Referring to FIG. 6, the sheet of paper (p) is fed along a predetermined paper traveling path between the support plate 33 and the cover plate 31 in the slant direction of an arrow "i" so as to be slid beneath the bottom end portion of the extending projection 54. At this time, the contact surface 43 of the extending contact arm 41 is in contact with the top surface of the support plate 33, and the rotatably moving rod 26 and the magnetic sensor 39 are maintained in an initially set state.

Referring to FIG. 7, as the sheet of paper (p) is fed along the predetermined paper traveling path between the support plate 33 and the cover plate 31 in the slant direction of an arrow "i", it first reaches the contact surface between the driving roller 12 and the driven roller 14 and then is slid beneath the bottom end portion of the extending projection 54 by means of the feeding force applied thereto from the driving roller 12 and the driven roller 14. At this time, the extending projection 54 is pushed upward by the thickness of the guided sheet of paper (p) while being rotated upward, which causes the rotating shaft 35 to angularly rotate in the counterclockwise direction of an arrow "k".

As the rotating shaft 35 rotates by a certain angle, the pivoting rod 26 pivots around the rotating shaft 35, and the link member 37 rotatably mounted to a free end of the pivoting rod 26 rotates in the counterclockwise direction relative to the pivoting rod 26, which causes the sensor shaft 51 of the magnetic sensor 39 to rotate in the direction of an arrow "m".

At this time, one sheet of paper passes beneath the bottom end portion of the extending projection 54, which means a normal operational state. Thus, a degree of angular rotation of the sensor shaft 51 is within a normal range, so that an erroneous signal is not generated.

On the other hand, as shown in FIG. 8, in the case where two overlapping sheets of paper (p) are slid beneath the bottom end portion of the extending projection 54, the ascending height of the extending projection 54 is twice that in the case of FIG. 7. Accordingly, the rotational angles of both the rotating shaft 35 and the sensor shaft 51 of the magnetic sensor 39 are also twice those in the case of FIG. 7, so that an error signal is generated.

It should, of course, be noted that in the case of the magnetic sensor 39, the rotational angle of the sensor shaft 51 required for generating an error signal could be determined when adjusting the settings of the paper feed sensing apparatus.

As described above, the paper feed sensing apparatus according to the present invention has the advantage of detecting a variation in the thickness of a sheet of paper being fed between the driving roller 12 and the driven roller 14 along the predetermined paper traveling path between the support plate 33 and the cover plate 31 by detecting a variation in the distance between the top surface 43 of the support plate 33 and the contact surface of the extending projection 54 of the extending contact arm 41 which is biased toward the top surface of the support plate 33, so that the machined very precisely rollers of the conventional art are not required.

While this invention has been particularly shown and described with reference to preferred embodiments thereof, it will be understood by those skilled in the art that various modifications may be made without departing from the spirit of the invention. The scope of the invention, therefore, is to be determined solely by the appended claims.

What is claimed is:

1. An apparatus for sensing the feeding of individual sheets of paper which is adapted for use with a sheet feeding apparatus including a plurality of pairs of a driving roller and a driven roller which continuously feed a plurality sheets of paper one by one along a predetermined paper traveling path, the apparatus for sensing the feeding of individual sheets of paper comprising:

a support plate mounted between and adapted to support a sheet of paper passing between the driving roller and driven roller of each of the plurality of pairs of a driving roller and a driven roller along the predetermined paper traveling path, the support plate having a plurality of driving roller through-holes formed thereon which allows the plurality of pairs of a driving roller and a driven roller to contact each other therethough;

a rotating shaft rotatably mounted over the top surface of the support plate, parallel to the support plate;

an extending contact arm fixedly mounted on the rotating shaft with one end portion thereof extending toward the support plate to contact the top surface of the support plate, the extending contact arm being moved upward from the top surface of the support plate by a height corresponding to the thickness of the sheet of paper when the sheet of paper passes along the support plate thus causing the rotating shaft to rotate;

an amplifying section operatively coupled to the rotating shaft to amplify an amount of rotation of the rotating shaft; and a sensor operatively coupled to the amplifying section for sensing the amount of rotation amplified by the amplifying section, wherein the feeding of two or more overlapping sheets of paper between the pairs of a driving roller and a driven roller is detected.

2. The apparatus as claimed in claim 1, further comprising a cover plate disposed between the support plate and the rotating shaft in parallel with and spaced apart from the support plate, thus defining the predetermined paper traveling path between the support plate and the cover plate and guiding the sheet of paper passing on the support plate along the predetermined paper traveling path, the cover plate having a plurality of driven roller through-holes which allow parts of lower portions of the driven rollers to pass therethrough so that the outer surfaces of both the driving rollers and the driven rollers contact each other, and a plurality of extending contact arm through-holes which are each disposed between two driven roller through-holes and allow bottom portions of the extending contact arms to pass therethrough so that the bottom portions of the extending projections contact the top surface of the support plate.

3. The apparatus as claimed in claim 1, wherein the amplifying section comprises:

a pivoting rod fixedly mounted at one end thereof on one end of the rotating shaft and extending perpendicular to the rotating shaft;

a connecting shaft fixedly connected to the other end of the pivoting rod and disposed parallel to the rotating shaft; and a link member rotatably connected at one end to the connecting shaft and disposed parallel to the pivoting rod.

4. The apparatus as claimed in claim 2, wherein the amplifying section comprises:

a pivoting rod fixedly mounted at one end thereof on one end of the rotating shaft and extending perpendicular to the rotating shaft;

a connecting shaft fixedly connected to the other end of the pivoting rod and disposed parallel to the rotating shaft; and a link member rotatably connected at one end to the connecting shaft and disposed parallel to the pivoting rod.

5. An apparatus for sensing the feeding of individual sheets of paper which is adapted for use with a sheet feeding apparatus including a plurality of pairs of a driving roller and a driven roller which continuously feed a plurality sheets of paper one by one along a predetermined paper traveling path, the apparatus for sensing the feeding of individual sheets of paper comprising:

a support plate mounted between and adapted to support a sheet of paper passing between the driving roller and driven roller of each of the plurality of pairs of a driving roller and a driven roller along the predetermined paper traveling path, the support plate having a plurality of driving roller through-holes formed thereon which allows the plurality of pairs of a driving roller and a driven roller to contact each other therethough;

a rotating shaft rotatably mounted over the top surface of the support plate, parallel to the support plate;

an extending contact arm fixedly mounted on the rotating shaft with one end portion thereof extending toward the support plate to contact the top surface of the support plate, the extending contact arm being moved upward from the top surface of the support plate by a height corresponding to the thickness of the sheet of paper when the sheet of paper passes along the support plate thus causing the rotating shaft to rotate;

an amplifying section operatively coupled to the rotating shaft to amplify an amount of rotation of the rotating shaft, wherein the amplifying section comprises:

a pivoting rod fixedly mounted at one end thereof on one end of the rotating shaft and extending perpendicular to the rotating shaft;

a connecting shaft fixedly connected to the other end of the pivoting rod and disposed parallel to the rotating shaft; and a link member rotatably connected at one end to the connecting shaft and disposed parallel to the pivoting rod; and a sensor operatively coupled to the amplifying section for sensing the amount of rotation amplified by the amplifying section, wherein the sensor is a magnetic sensor with a rotational center axis is fixedly connected to the other end of the link member, wherein the feeding of two or more overlapping sheets of paper between the pairs of a driving roller and a driven roller is detected.

6. An apparatus for sensing the feeding of individual sheets of paper which is adapted for use with a sheet feeding apparatus including a plurality of pairs of a driving roller and a driven roller which continuously feed a plurality sheets of paper one by one along a predetermined paper traveling path, the apparatus for sensing the feeding of individual sheets of paper comprising:

a support plate mounted between and adapted to support a sheet of paper passing between the driving roller and driven roller of each of the plurality of pairs of a driving roller and a driven roller along the predetermined paper traveling path, the support plate having a plurality of driving roller through-holes formed thereon which allows the plurality of pairs of a driving roller and a driven roller to contact each other therethough;

a rotating shaft rotatably mounted over the top surface of the support plate, parallel to the support plate;

a cover plate disposed between the support plate and the rotating shaft in parallel with and spaced apart from the support plate, thus defining the predetermined paper traveling path between the support plate and the cover elate and guiding the sheet of paper passing on the support plate along the predetermined paper traveling path, the cover plate having a plurality of driven roller through-holes which allow parts of lower portions of the driven rollers to pass therethrough so that the outer surfaces of both the driving rollers and the driven rollers contact each other, and a plurality of extending contact arm through-holes which are each disposed between two driven roller through-holes and allow bottom portions of the extending contact arms to pass therethrough so that the bottom portions of the extending projections contact the top surface of the support plate;

an extending contact arm fixedly mounted on the rotating shaft with one end portion thereof extending toward the support plate to contact the top surface of the support plate, the extending contact arm being moved upward from the top surface of the support plate by a height corresponding to the thickness of the sheet of paper when the sheet of paper passes along the support plate thus causing the rotating shaft to rotate;

an amplifying section operatively coupled to the rotating shaft to amplify an amount of rotation of the rotating shaft, wherein the amplifying section comprises:

a pivoting rod fixedly mounted at one end thereof on one end of the rotating shaft and extending perpendicular to the rotating shaft;

a connecting shaft fixedly connected to the other end of the pivoting rod and disposed parallel to the rotating shaft; and a link member rotatably connected at one end to the connecting shaft and disposed parallel to the pivoting rod; and a sensor operatively coupled to the amplifying section for sensing the amount of rotation amplified by the amplifying section, wherein the sensor is a magnetic sensor with a rotational center axis is fixedly connected to the other end of the link member, wherein the feeding of two or more overlapping sheets of paper between the pairs of a driving roller and a driven roller is detected.

7. The apparatus as claimed in claim 3, wherein the length of the end portion of the extending contact arm extending toward the support plate is smaller than that of the pivoting rod.

8. An apparatus for sensing the feeding of individual sheets of paper, comprising:

a support plate mounted between and adapted to support a sheet of paper passing between multiple opposed roller pairs along a predetermined paper traveling path;

an extending contact arm movably mounted with one end portion thereof extending into said paper path to contact said support plate;

a mechanical amplifying section operatively coupled to amplify movement of said contact arm; and a sensor operatively coupled to the amplifying section for sensing the amount of rotation amplified by the amplifying section, wherein the feeding of two or more overlapping sheets of paper between the pairs of a driving roller and a driven roller is detected.

9. The apparatus of claim 8, wherein support plate is curved.

10. The apparatus of claim 8, wherein said sensor is a magnetic sensor.

11. A method for sensing the feeding of individual sheets of paper, comprising the steps of:

positioning an extending projection of a first arm, which is mounted to a rotating shaft, to be deflected by paper passing through a paper path;

translating motion of a second arm, which is also mounted to said rotating shaft, into a further mechanical motion; and sensing said further mechanical motion to detect presence of paper in said paper path.

12. The method of claim 11, wherein said second arm extends farther from said shaft than does said first arm.

13. The method of claim 11, wherein said sensing step uses a magnetic sensor.

14. The method of claim 11, wherein said paper path carries paper currency.

15. A method for sensing the feeding of individual sheets of paper, comprising the steps of:

allowing an extending projection to be deflected by sheets of paper passing through a paper path;

mechanically coupling motion of said projection to cause motion of a second element;

mechanically coupling motion of said second element to cause motion of a third element; and sensing motion of said third element to detect presence of paper in said paper path.

16. The method of claim 15, wherein said motion of said second element is greater than deflection of said projection.

17. The method of claim 15, wherein said sensing step uses a magnetic sensor.

18. A method for sensing the feeding of individual sheets of paper, comprising the steps of:

positioning an extending projection of a first arm, which is mounted to a rotating shaft, within a paper path;

and, when said projection is deflected by passage of a sheet of paper through said paper path, translating a resulting rotation of said shaft into a further mechanical motion; and sensing said further mechanical motion to detect presence of paper in said paper path.

19. The method of claim 18, wherein said further mechanical motion is greater than deflection of said projection.

20. The method of claim 18, wherein said paper path carries paper currency.

* * * * *